US009583293B2

(12) United States Patent
Li et al.

(10) Patent No.: US 9,583,293 B2
(45) Date of Patent: Feb. 28, 2017

(54) ELECTROMAGNETIC RELAY

(71) Applicant: FUJITSU COMPONENT LIMITED, Tokyo (JP)

(72) Inventors: Ying Li, Tokyo (JP); Masahiro Kaneko, Tokyo (JP); Nobuo Yatsu, Tokyo (JP); Takuya Uchiyama, Tokyo (JP); Yayoi Tokuhara, Tokyo (JP); Kohei Takahashi, Tokyo (JP); Katsuaki Koshimura, Tokyo (JP); Chuqi Liang, Tokyo (JP); Miki Kitahara, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 14/686,933

(22) Filed: Apr. 15, 2015

(65) Prior Publication Data

US 2015/0303015 A1 Oct. 22, 2015

(30) Foreign Application Priority Data

Apr. 17, 2014 (JP) ..... 2014-085830

(51) Int. Cl.

| | |
|---|---|
| ***H01H 50/64*** | (2006.01) |
| ***H01H 50/54*** | (2006.01) |
| ***H01H 50/18*** | (2006.01) |
| ***H01H 9/32*** | (2006.01) |
| ***H01H 50/24*** | (2006.01) |

(52) U.S. Cl.
CPC ..... *H01H 50/642* (2013.01); *H01H 9/32* (2013.01); *H01H 50/18* (2013.01); *H01H 50/24* (2013.01); *H01H 50/54* (2013.01)

(58) Field of Classification Search
CPC ..... H01H 50/18; H01H 50/54; H01H 71/522
See application file for complete search history.

(56) References Cited

U.S. PATENT DOCUMENTS

| | | | | |
|---|---|---|---|---|
| 2,853,578 A * | 9/1958 | Rommel | ..... | H01H 1/26 200/280 |
| 3,239,629 A * | 3/1966 | Lesser | ..... | H01H 50/54 200/285 |
| 3,488,609 A * | 1/1970 | Stokes | ..... | H01H 71/522 335/16 |
| 2015/0084724 A1* | 3/2015 | Gonzales | ..... | H01H 47/22 335/158 |

FOREIGN PATENT DOCUMENTS

| | | | | |
|---|---|---|---|---|
| DE | WO 9428567 A1 * | 12/1994 | ..... | H01H 9/542 |
| JP | 2010-020975 | 1/2010 | | |
| JP | 2012069365 A * | 4/2012 | | |

* cited by examiner

*Primary Examiner* — Mohamad Musleh
(74) *Attorney, Agent, or Firm* — IPUSA, PLLC

(57) ABSTRACT

An electromagnetic relay includes a coil, an armature, an iron core, a card, a first contact, and a second contact. The card is connected to the armature and formed of an insulating material. The first contact and the second contact are in contact when there is no flow of electric current through the coil. The first contact and the second contact are separated with the armature being attracted to the iron core to interpose the card between the first contact and the second contact when there is a flow of electric current through the coil.

9 Claims, 7 Drawing Sheets

ELECTROMAGNETIC RELAY

CROSS-REFERENCE TO RELATED APPLICATION

The present application is based upon and claims the benefit of priority of Japanese Patent Application No. 2014-085830, filed on, Apr. 17, 2014, the entire contents of which are incorporated herein by reference.

BACKGROUND OF THE INVENTION

1. Field of the Invention

The present invention relates to electromagnetic relays.

2. Description of the Related Art

Electromagnetic relays are devices that control the opening and closing of a contact using an electromagnet. According to the electromagnetic relay, a magnetic field is generated by causing electric current to flow through the coil of the electromagnet, and an armature is attracted to an iron core by the generated magnetic field so as to cause a movable contact to come into contact and make a connection with a fixed contact, so that electric power is supplied through the electromagnetic relay. On the other hand, when the supply of electric current flowing through the coil is stopped, the magnetic field that has been generated disappears, so that the armature is moved away from the iron core by the restoring force of a spring or the like. As a result, the movable contact is separated from and breaks the contact with the fixed contact, so that the electric current that has been supplied through the electromagnetic relay is interrupted.

Reference may be made to Japanese Laid-Open Patent Application No. 2010-20975 for related art.

SUMMARY OF THE INVENTION

According to an aspect of the present invention, an electromagnetic relay includes a coil, an armature, an iron core, a card, a first contact, and a second contact. The card is connected to the armature and formed of an insulating material. The first contact and the second contact are in contact when there is no flow of electric current through the coil. The first contact and the second contact are separated with the armature being attracted to the iron core to interpose the card between the first contact and the second contact when there is a flow of electric current through the coil.

According to an aspect of the present invention, an electromagnetic relay includes a coil, an armature, an iron core, a card, a first contact, and a second contact. The card is connected to the armature and formed of an insulator. The first contact and the second contact are separated with the card being interposed between the first contact and the second contact when there is no flow of electric current through the coil. The armature is attracted to the iron core so as to move the card to bring the first contact and the second contact into contact when there is a flow of electric current through the coil.

According to an aspect of the present invention, an electromagnetic relay includes a coil, an armature, an iron core, a scissors-shaped insulating member, a first contact, and a second contact. The scissors-shaped insulating member is connected to the armature by a rod and configured to be opened and closed by a movement of the rod. The scissors-shaped insulating member is opened to bring the first contact and the second contact into contact when there is no flow of electric current through the coil. The armature is attracted to the iron core so as to move the rod to close the scissors-shaped insulating member so that the scissors-shaped insulating member is interposed between the first contact and second contact so as to separate the first contact and the second contact when there is a flow of electric current through the coil.

BRIEF DESCRIPTION OF THE DRAWINGS

FIGS. 4A and 45 are perspective views of an electromagnetic relay according to a second embodiment;

DESCRIPTION OF THE EMBODIMENTS

Figure 1:
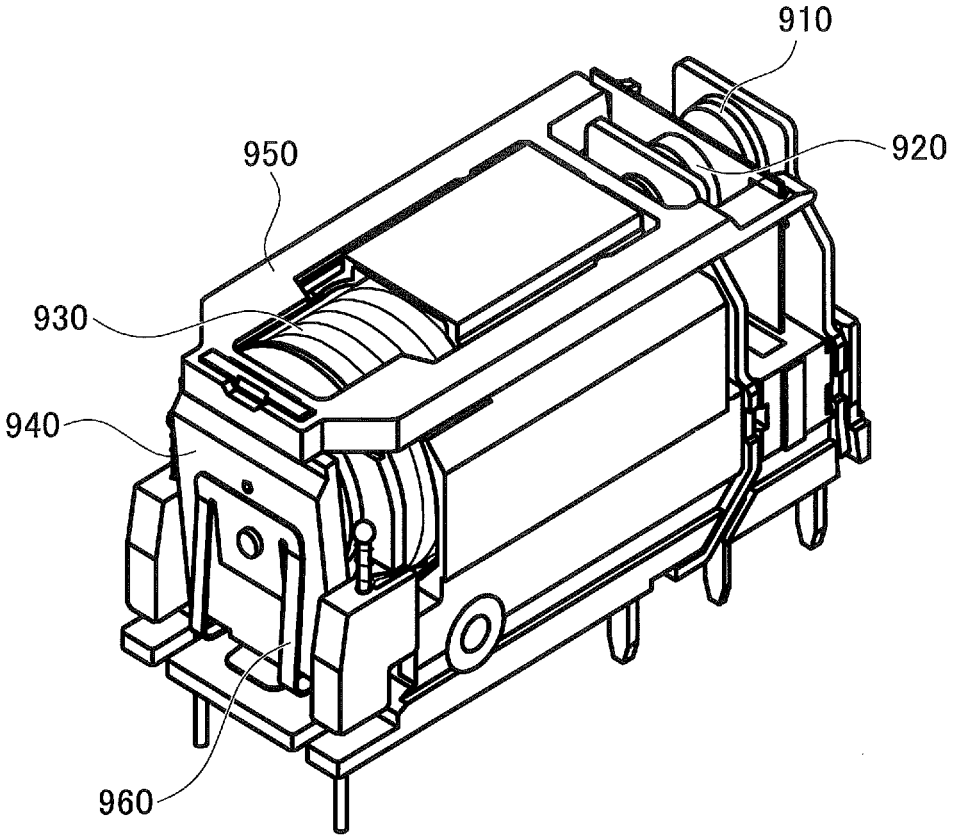
FIG. 1 is a perspective view of an electromagnetic relay.

Embodiments of the present invention are described below with reference to the accompanying drawings. The same elements are referred to by the same reference numeral, and are not further described.

First Embodiment

First, an electromagnetic relay is described with reference to FIG. 1. The electromagnetic relay illustrated in FIG. 1 includes a fixed spring contact 910, a movable spring contact 920, a coil 930, an armature 940, a card 950, a hinge spring 960, and an iron core. According to the electromagnetic relay illustrated in FIG. 1, a magnetic field is generated by causing electric current to flow through the coil 930, and the armature 940 is attracted to the iron core by a magnetic force due to the generated magnetic field, so that the card 950 moves. When the card 950 moves, the movable spring contact 920, which is in contact with an end of the card 950, is pressed so as to come into contact with the fixed spring contact 910. As a result, electric power is supplied to the fixed spring contact 910 via the movable spring contact 920.

On the other hand, when the supply of electric current flowing through the coil 930 is stopped, the magnetic field that has been generated disappears, so that the magnetic force that has attracted the armature 940 to the iron core disappears. Therefore, the armature 940 is returned to the original state by the restoring force of the hinge spring 960. As a result, the card 950 also moves in a direction to separate the movable spring contact 920 from the fixed spring contact 910, so that the movable spring contact 920 is separated from the fixed spring contact 910 so as to interrupt the supply of electric power. At this point, if the electric power supplied to the electromagnetic relay is of high voltage, an arc is generated when the movable spring contact 920 separates from the fixed spring contact 910. When an arc is generated, the fixed spring contact 910 or the movable spring contact 920 may be heated and fused to be broken by the heat of the generated arc.

Accordingly, there is a demand for an electromagnetic relay that is free of arc generation even when the electric power supplied to the electromagnetic relay is of high voltage.

Figure 2A:
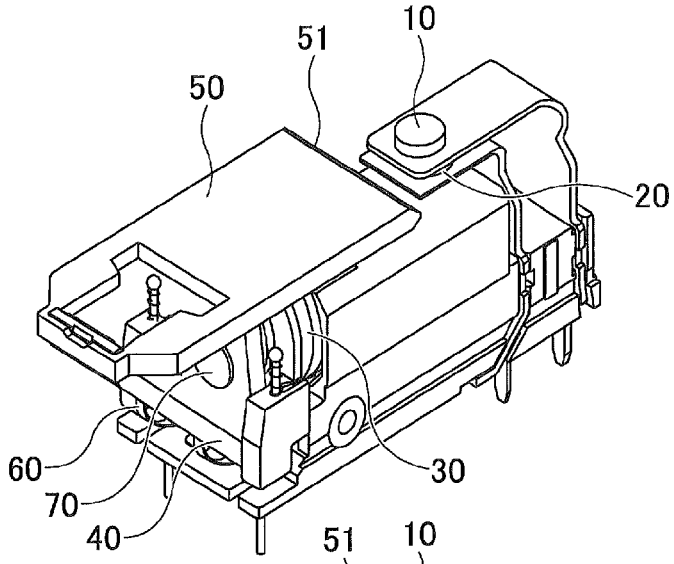
FIGS. 2A and 2B are perspective views of an electromagnetic relay according to a first embodiment.
Figure 2B:
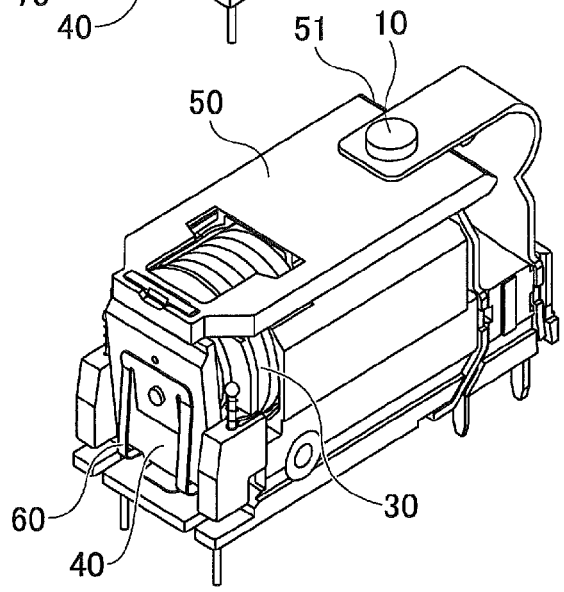
Figure 3A:
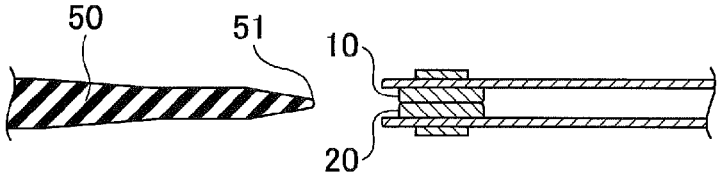
FIGS. 3A and 3B are diagrams illustrating the electromagnetic relay according to the first embodiment.
Figure 3B:
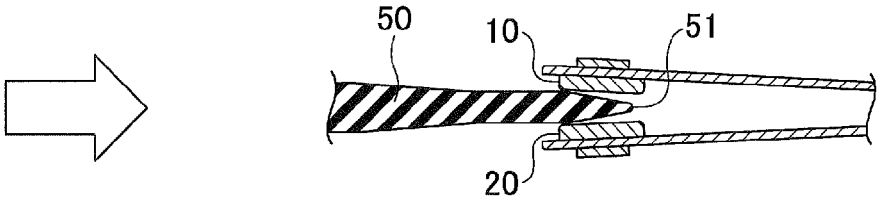

Next, an electromagnetic relay according to the first embodiment is described with reference to FIGS. 2A, 2B, 3A and 3B. FIGS. 2A and 2B are perspective views of the electromagnetic relay according to this embodiment. FIG. 2A illustrates a state where the connection of contacts is made. FIG. 2B illustrates a state where the connection of contacts is broken. FIGS. 3A and 3B are enlarged views of part of the electromagnetic relay according to this embodiment. FIG. 3A illustrates a state where the connection of contacts is made. FIG. 3B illustrates a state where the connection of contacts is broken.

The electromagnetic relay according to this embodiment includes a first fixed spring contact 10, a second fixed spring contact 20, a coil 30, an armature 40, a card 50, a hinge spring 60, and an iron core 70. According to the electromagnetic relay of this embodiment, when there is no flow of electric current through the coil 30, the first and second fixed spring contacts 10 and 20 are in contact as illustrated in FIGS. 2A and 3A, so that electric power is supplied to a circuit connected to the electromagnetic relay via the electromagnetic relay. The first and second fixed spring contacts 10 and 20 are formed of, for example, AgNi or the like.

On the other hand, according to the electromagnetic relay of this embodiment, a magnetic field is generated by causing electric current to flow through the coil 30, so that the armature 40 is attracted to the iron core 70 by a magnetic force due to the generated magnetic field as illustrated in FIGS. 2B and 3B. When the armature 40 is attracted to the iron core 70, the card 50 connected to an end of the armature 40 moves to interpose between the first and second fixed spring contacts 10 and 20. As a result of the card 50 thus interposing with an end 51 first between the first and second fixed spring contacts 10 and 20, the first and second fixed spring contacts 10 and 20 are separated, so that the supply of electric power is interrupted. According to this embodiment, the card 50 is formed of an insulator such as a resin or ceramic material. Accordingly, it is possible to prevent generation of an arc because the first and second fixed spring contacts 10 and 20 are not simply separated, but the card 50 formed of an insulator interposes between the first and second fixed spring contacts 10 and 20. The card 50 has a tapered end that becomes more pointed toward the end 51 so as to facilitate interposition between the first and second fixed spring contacts 10 and 20.

Next, when the supply of electric current flowing through the coil 30 is stopped, the magnetic field that has been generated disappears, so that the magnetic force that has attracted the armature 40 to the coil 30 disappears. Therefore, the armature 40 is returned to the original state by the restoring force of the hinge spring 60. As a result, the card 50 also moves in a direction to be pulled out from between the first and second fixed spring contacts 10 and 20, so that the first and second fixed spring contacts 10 and 20 come into contact and electric power is supplied via the electromagnetic relay. That is, the electromagnetic relay returns to the state illustrated in FIGS. 2A and 3A.

According to the electromagnetic relay of this embodiment, at the time of interrupting the supply of electric power, the card 50 formed of an insulator interposes between the first and second fixed spring contacts 10 and 20 to break the connection of the first and second fixed spring contacts 10 and 20, so that the supply of electric power is interrupted. Therefore, even when the electric power supplied to the electromagnetic relay is of high voltage, there is no generation of an arc between the first and second fixed spring contacts 10 and 20. Accordingly, the first and second fixed spring contacts 10 and 20 are prevented from being fused or broken by the heat of an arc.

Furthermore, the card 50, which is formed of an insulator such as a resin or ceramic material as described above, is preferably formed of a fluoropolymer such as Teflon (registered trademark), or polyoxymethylene (POM) because these materials have high heat resistance and high electrical insulation.

Second Embodiment

Figure 4A:
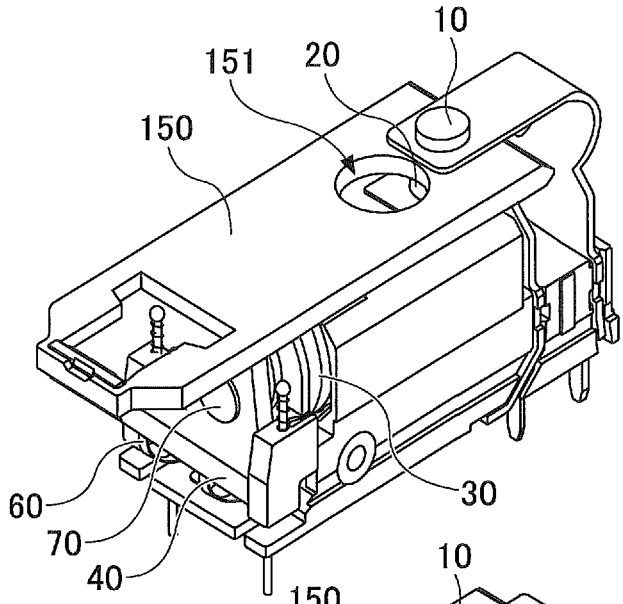
Figure 4B:
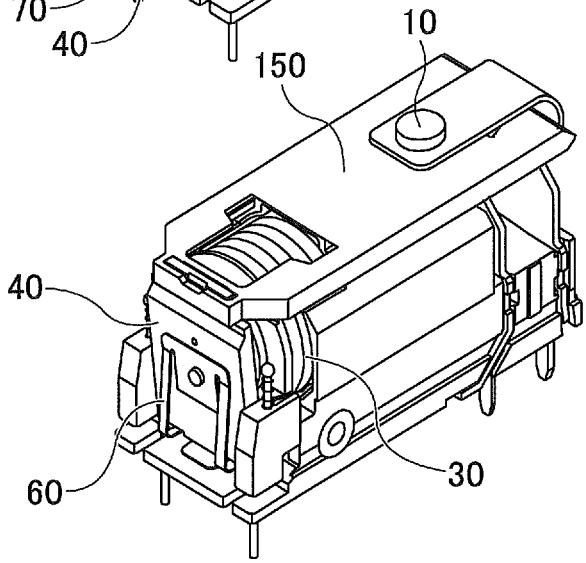
Figure 5A:
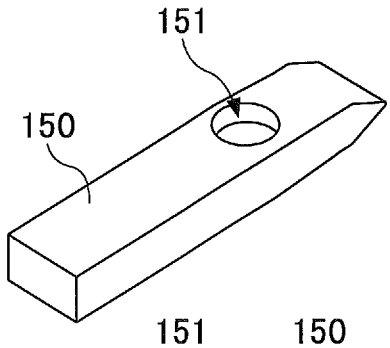
FIGS. 5A and 5B are diagrams illustrating the electromagnetic relay according to the second embodiment.
Figure 5B:
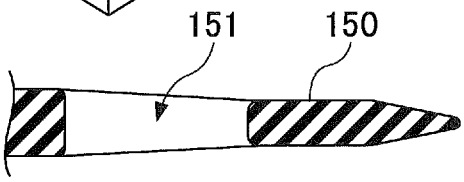

Next, an electromagnetic relay according to a second embodiment is described with reference to FIGS. 4A, 4B, 5A and 5B. FIGS. 4A and 4B are perspective views of the electromagnetic relay according to this embodiment. FIG. 4A illustrates a state where the connection of contacts is broken. FIG. 4B illustrates a state where the connection of contacts is made. Furthermore, FIGS. 5A and 5B are diagrams illustrating part of a card 150 according to this embodiment. According to the electromagnetic relay of this embodiment, a through hole 151 is formed in the card 150 as illustrated in FIGS. 5A and 5B, and the first and second fixed spring contacts 10 and 20 are allowed to enter the through hole 151. The first and second fixed spring contacts 10 and 20 enter the through hole 151 in the card 150 so as to come into contact with each other, so that electric power is supplied via the electromagnetic relay.

The electromagnetic relay according to this embodiment includes the first fixed spring contact 10, the second fixed spring contact 20, the coil 30, the armature 40, the card 150, the hinge spring 60, and the iron core 70. According to the electromagnetic relay of this embodiment, when there is no flow of electric current through the coil 30, the card 150 formed of an insulator is interposed between the first and second fixed spring contacts 10 and 20 as illustrated in FIG. 4A. As a result, the connection of the first and second fixed spring contacts 10 and 20 is broken, so that no electric power is supplied.

On the other hand, according to the electromagnetic relay of this embodiment, a magnetic field is generated by causing electric current to flow through the coil 30, so that the armature 40 is attracted to the iron core 70 by a magnetic force due to the generated magnetic field as illustrated in FIG. 4B. When the armature 40 is attracted to the iron core 70, the card 150 connected to an end of the armature 40 moves further inward between the first and second fixed spring contacts 10 and 20. As a result, the first and second fixed spring contacts 10 and 20 enter the through hole 151 provided in the card 150. In this state, the first and second fixed spring contacts 10 and 20 are in contact in the through hole 151 of the card 150, so that electric power is supplied via the electromagnetic relay.

Next, when the supply of electric current flowing through the coil 30 is stopped, the magnetic field that has been generated disappears, so that the magnetic force that has attracted the armature 40 to the coil 30 disappears. Therefore, the armature 40 is returned to the original state by the restoring force of the hinge spring 60. As a result, the card 150 moves in a direction to move the through hole 151 away from between the first and second fixed spring contacts 10 and 20 as illustrated in FIG. 4A. Consequently, the first and second fixed spring contacts 10 and 20 come out of the through hole 151, so that the card 150 formed of an insulator is held between the first and second fixed spring contacts 10 and 20. Thus, the first and second fixed spring contacts 10 and 20 are separated, so that the supply of electric power is interrupted. According to this embodiment, the card 150 is formed of an insulator as described above. Therefore, no arc is generated because the first and second fixed spring contacts 10 and 20 are not simply separated, but the card 150 formed of an insulator interposes between the first and second fixed spring contacts 10 and 20.

According to the electromagnetic relay of this embodiment, at the time of interrupting the supply of electric power, the card 150 formed of an insulator interposes between the first and second fixed spring contacts 10 and 20. Therefore, even when the supplied electric power is of high voltage, there is no generation of an arc between the first and second fixed spring contacts 10 and 20. Accordingly, the first and second fixed spring contacts 10 and 20 are prevented from being fused or broken by the heat of an arc.

The card 150, which is formed of an insulator such as a resin or ceramic material as described above, is preferably formed of a fluoropolymer such as Teflon (registered trademark), or POM the same as in the first embodiment.

Third Embodiment

Figure 6A:
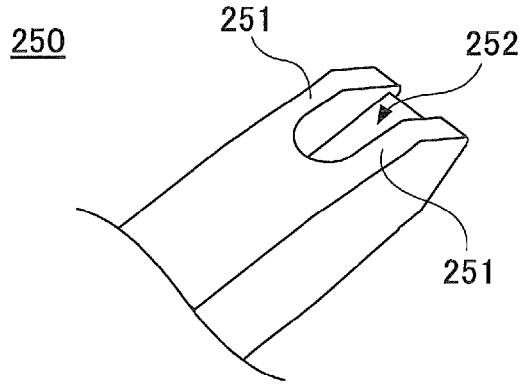
FIGS. 6A and 6B are diagrams illustrating an electromagnetic relay according to a third embodiment.
Figure 6B:
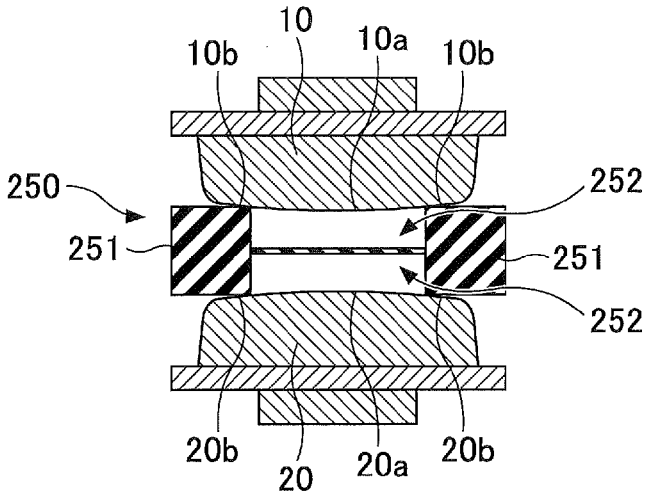

Next, an electromagnetic relay according to a third embodiment is described with reference to FIGS. 6A and 6B. FIG. 6A is a perspective view of part of a card 250 of the electromagnetic relay according to this embodiment. FIG. 6B is a cross-sectional view of part of the electromagnetic relay according to this embodiment.

Referring to FIG. 6B, the first fixed spring contact 10 includes a contact part 10*a* and a peripheral part 10*b*, and the second fixed spring contact 20 includes a contact part 20*a* and a peripheral part 20*b*. The contact parts 10*a* and 20*a* come into contact and the peripheral parts 10*b* and 20*b* do not come into contact when the first and second fixed spring contacts 10 and 20 come into contact.

According to the electromagnetic relay of this embodiment, an end portion of the card 250 is grooved so that a groove 252 is formed between sidewalls 251 on each side of the end portion in a thickness direction of the card 250 (a vertical direction in FIG. 6B). Referring to FIG. 6B, part of the end portion of the card 250 in which the grooves 252 are formed is sufficiently thinner than the sidewalls 251. Accordingly, when the card 250 interposes between the first and second fixed spring contacts 10 and 20, the card 250 separates the first and second fixed spring contacts 10 and 20 without coming into contact with the contact parts 10*a* and 20*a*.

That is, according to the first embodiment, when the card 50 repeatedly interposes between the first and second fixed spring contacts 10 and 20, the contact parts 10*a* and 20*a* of the first and second fixed spring contacts 10 and 20 may be worn away by the card 50. When the contact parts 10*a* and 20*a* are worn away by the card 50 so as to deform, the state of contact of the first and second fixed spring contacts 10 and 20 becomes unstable, so that there may occur connection failure between the first and second fixed spring contacts 10 and 20.

On the other hand, according to this embodiment, when the card 250 interposes between the first and second fixed spring contacts 10 and 20, the sidewalls 251 of the card 250 come into contact with and separate the first and second fixed spring contacts 10 and 20. Parts of the first and second fixed spring contacts 10 and 20 that come into contact with the sidewalls 251 of the card 250 are the peripheral parts 10*b* and 20*b*, which are apart from the contact parts 10*a* and 20*a*, respectively. Accordingly, the contact parts 10*a* and 20*a* of the first and second fixed spring contacts 10 and 20 are prevented from coming into contact with the card 250 because the contact parts 10*a* and 20*a* enter the grooves 252 of the card 250.

The peripheral parts 10*b* and 20*b* of the first and second fixed spring contacts 10 and 20 do not contribute to the contact of the first and second fixed spring contacts 10 and 20. Therefore, even when the peripheral parts 10*b* and 20*b* are somewhat worn by coming into contact with the sidewalls 251 of the card 250, no connection failure occurs between the first and second fixed spring contacts 10 and 20, so that the supply of electric power does not become unstable. Therefore, according to this embodiment, the interposition of the card 250 between the first and second fixed spring contacts 10 and 20 makes it possible to separate the first and second fixed spring contacts 10 and 20 without wearing away the contact parts 10*a* and 20*a* of the first and second fixed spring contacts 10 and 20. Furthermore, the grooved part of the card 250 where the grooves 252 are formed is thin but formed of an insulator. Therefore, it is possible for the grooved part of the card 250 to interrupt an arc generated between the first and second fixed spring contacts 10 and 20.

Fourth Embodiment

Figure 7:
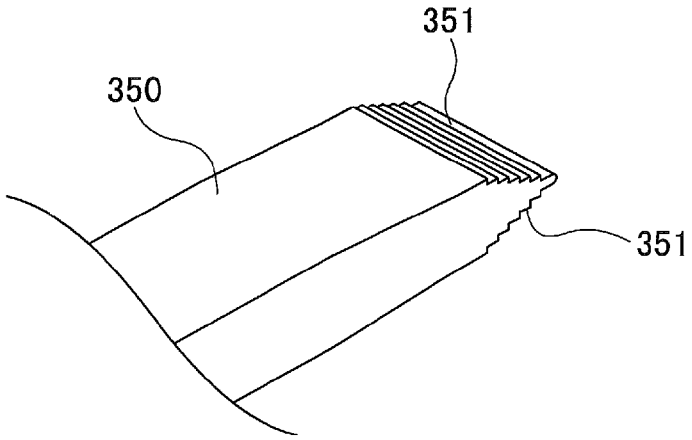
FIG. 7 is a diagram illustrating an electromagnetic relay according to a fourth embodiment.

Next, an electromagnetic relay according to a fourth embodiment is described with reference to FIG. 7. According to the electromagnetic relay of this embodiment, irregularities (projections and depressions) are formed in an end portion of a card. Specifically, as illustrated in FIG. 7, irregularities 351 are formed in an end portion of a card 350 of the electromagnetic relay according to this embodiment. The irregularities 351 may be formed by forming grooves or projections on a surface of the end portion of the card 350. For example, the end portion of the card 350 may include a stepped surface. By thus forming the irregularities 351 in the end portion of the card 350, it is possible to remove dust and the like adhering to the contact parts 10*a* and 20*a* of the first and second fixed spring contacts 10 and 20. Furthermore, when the contact parts 10*a* and 20*a* have oxidized surfaces, it is possible to remove an oxide film on the surfaces of the contact parts 10*a* and 20*a*. As a result, it is possible to ensure the contact of the first and second fixed spring contacts 10 and 20, so that it is possible to ensure a supply of electric power through the first and second fixed spring contacts 10 and 20. The fourth embodiment may be otherwise the same as the first embodiment.

Fifth Embodiment

Figure 8A:
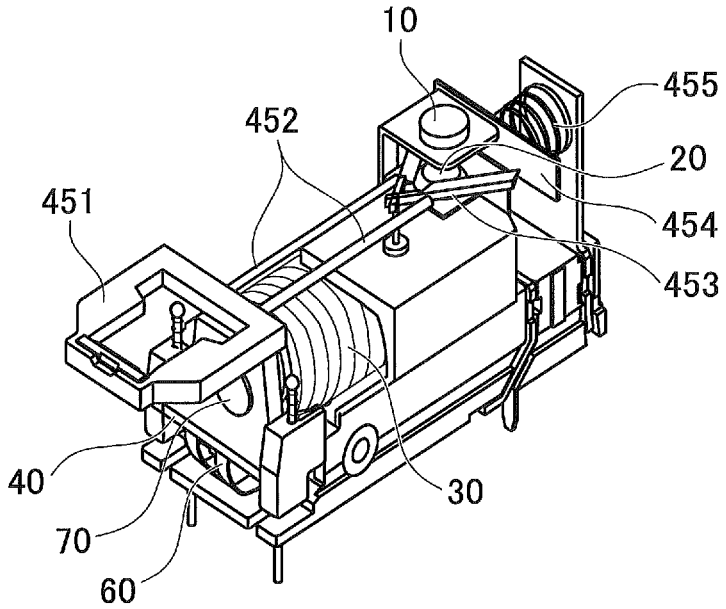
FIGS. 8A and 8B are perspective views of an electromagnetic relay according to a fifth embodiment.
Figure 8B:
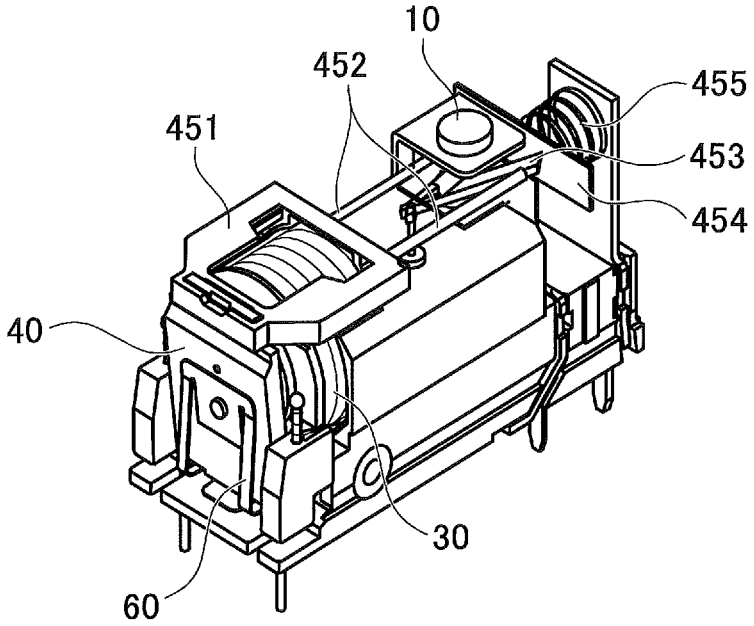

Next, an electromagnetic relay according to a fifth embodiment is described with reference to FIGS. 8A and 8B. FIGS. 8A and 8B are perspective views of the electromagnetic relay according to this embodiment. FIG. 8A illustrates a state where the connection of contacts is made. FIG. 8B illustrates a state where the connection of contacts is broken.

The electromagnetic relay according to this embodiment includes the first fixed spring contact 10, the second fixed spring contact 20, the coil 30, the armature 40, the hinge spring 60, the iron core 70, a card plate 451, card bars 452, an insulating member 453, an insulating plate 454, and a spring 455. According to the electromagnetic relay of this embodiment, when there is no flow of electric current through the coil 30, the first and second fixed spring contacts 10 and 20 are in contact as illustrated in FIG. 8A, so that electric power is supplied via the electromagnetic relay.

On the other hand, according to the electromagnetic relay of this embodiment, a magnetic field is generated by causing electric current to flow through the coil 30, so that the armature 40 is attracted to the iron core 70 by a magnetic force due to the generated magnetic field as illustrated in FIG. 8B. When the armature 40 is attracted to the iron core 70, the card plate 451 connected to an end of the armature 40 and the two card bars 452 connected to the card plate 451 move toward the first and second fixed spring contacts 10 and 20. The insulating member 453, which is formed of two members into a scissor shape so as to be openable and closable, is provided near the first and second fixed spring contacts 10 and 20. The insulating member 453 is in contact with the two card bars 452.

According to this embodiment, when there is no flow of electric current through the coil 30, the insulating member 453 is opened, so that the first and second fixed spring contacts 10 and 20 are kept in contact. By causing electric current to flow through the coil 30, however, the armature 40 moves so as to press the insulating member 453 by the two card bars 452 through the card plate 451, so that the insulating member 453 is closed. As a result, the closed insulating member 453 interposes between the first and second fixed spring contacts 10 and 20 so as to interrupt the supply of electric power. According to this embodiment, the insulating member 453 is formed of an insulator. Accordingly, it is possible to prevent generation of an arc because the first and second fixed spring contacts 10 and 20 are not simply separated, but the insulating member 453 interposes between the first and second fixed spring contacts 10 and 20.

Next, when the supply of electric current flowing through the coil 30 is stopped, the magnetic field that has been generated disappears, so that the magnetic force that has attracted the armature 40 to the coil 30 disappears. Therefore, the armature 40 is returned to the original state by the restoring force of the hinge spring 60. As a result, the card plate 451 also moves away from the first and second fixed spring contacts 10 and 20, so that the scissors-shaped insulating member 453 is opened by the restoring force of the spring 455 via the insulating plate 454. As a result, the first and second fixed spring contacts 10 and 20 come into contact. Thus, the electromagnetic relay returns to the state illustrated in FIG. 8A, so that electric power is supplied via the electromagnetic relay.

According to the electromagnetic relay of this embodiment, at the time of interrupting the supply of electric power, the scissors-shaped insulating member 453 interposes between the first and second fixed spring contacts 10 and 20 so as to interrupt the supply of electric power. Therefore, even when the supplied electric power is of high voltage, there is no generation of an arc between the first and second fixed spring contacts 10 and 20. Accordingly, the first and second fixed spring contacts 10 and 20 are prevented from being fused or broken by the heat of an arc.

The scissors-shaped insulating member 453, which is formed of an insulator such as a resin or ceramic material as described above, is preferably formed of a fluoropolymer such as Teflon (registered trademark), or POM because these materials have high heat resistance and high electrical insulation.

Sixth Embodiment

Figure 9A:
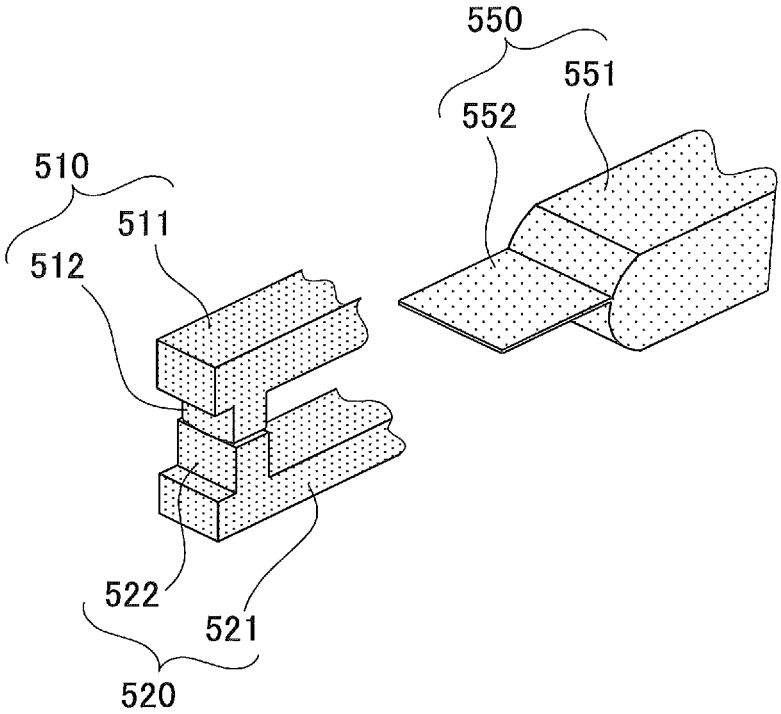
FIGS. 9A and 9B are diagrams illustrating an electromagnetic relay according to a sixth embodiment.
Figure 9B:
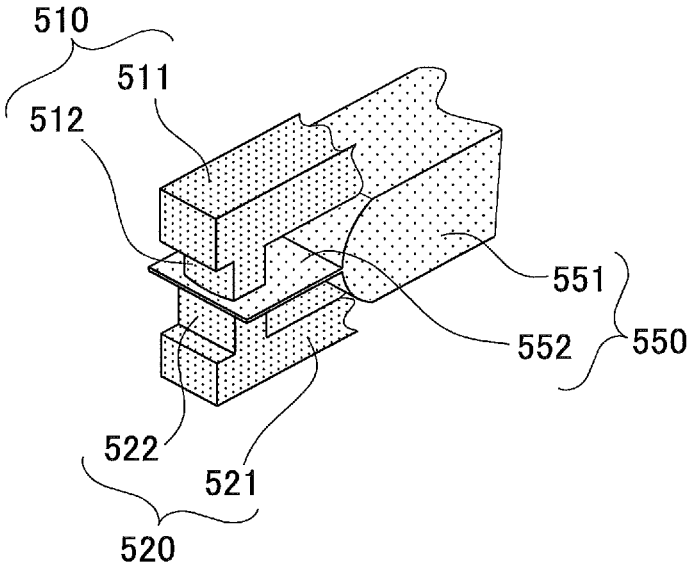

Next, an electromagnetic relay according to a sixth embodiment is described with reference to FIGS. 9A and 9B. FIGS. 9A and 9B are perspective views of part of the electromagnetic relay according to this embodiment. FIG. 9A illustrates a state where the connection of contacts is made. FIG. 9B illustrates a state where the connection of contacts is broken.

The electromagnetic relay according to this embodiment includes a first fixed spring contact 510, a second fixed spring contact 520, and a card 550. The first fixed spring contact 510 includes a first fixed spring support 511 and a first contact projection 512 provided on an end portion of the first fixed spring support 511. The second fixed spring contact 520 includes a second fixed spring support 521 and a second contact projection 522 provided on an end portion of the second fixed spring support 521. The first and second fixed spring contacts 510 and 520 are in contact through the contact of the first and second contact projections 512 and 522.

The card 550 is formed of an insulator and includes a card body 551 and an end portion 552 that is thinner than the card body 551. According to the electromagnetic relay of this embodiment, when there is no flow of electric current through the coil 30, the first and second contact projections 512 and 522 are in contact as illustrated in FIG. 9A. Accordingly, electric power is supplied via the electromagnetic relay.

A magnetic field is generated by causing electric current to flow through the coil 30, so that the card 550 interposes between the first and second fixed spring contacts 510 and 520 because of a magnetic force due to the generated magnetic field as illustrated in FIG. 9B. At this point, first, the card body 551 of the card 550 comes into contact with the first and second fixed spring supports 511 and 521. As a result, the interval between the first and second fixed spring contacts 510 and 520 increases, so that the first and second contact projections 512 and 522 are separated so as to interrupt the supply of electric power. At this point, the thin end portion 552 of the card body 550 interposes between the first and second contact projections 512 and 522. Therefore, it is possible to prevent generation of an arc. Furthermore, when the first and second contact projections 512 and 522 are separated, the first and second contact projections 512 and 522 and the card 550 do not come into contact. Therefore, it is possible to prevent the wear of the first and second contact projections 512 and 522.

The sixth embodiment may be otherwise the same as the first embodiment. The card 550, which is formed of an insulator such as a resin or ceramic material as described above, is preferably formed of a fluoropolymer such as Teflon (registered trademark), or POM because these materials have high heat resistance and high electrical insulation.

Seventh Embodiment

Next, an electromagnetic relay according to a seventh embodiment is described with reference to FIG. 10. An electromagnetic relay according to this embodiment includes multiple pairs, for example, two pairs, of a first fixed spring contact and a second fixed spring contact. For example, referring to FIG. 10, the electromagnetic relay according to this embodiment includes two first fixed spring contacts 611 and 612. Furthermore, although not illustrated in FIG. 10, the electromagnetic relay includes two second fixed spring contacts corresponding to the two first fixed spring contacts 611 and 612. The first fixed spring contacts 611 and 612 and the second fixed spring contacts are the same as the first and second fixed spring contacts 10 and 20 according to the first embodiment.

Furthermore, the electromagnetic relay includes a card 650 in which an opening 651 is formed. The card 650 is formed of the same material as the card 50 according to the first embodiment.

Figure 10:
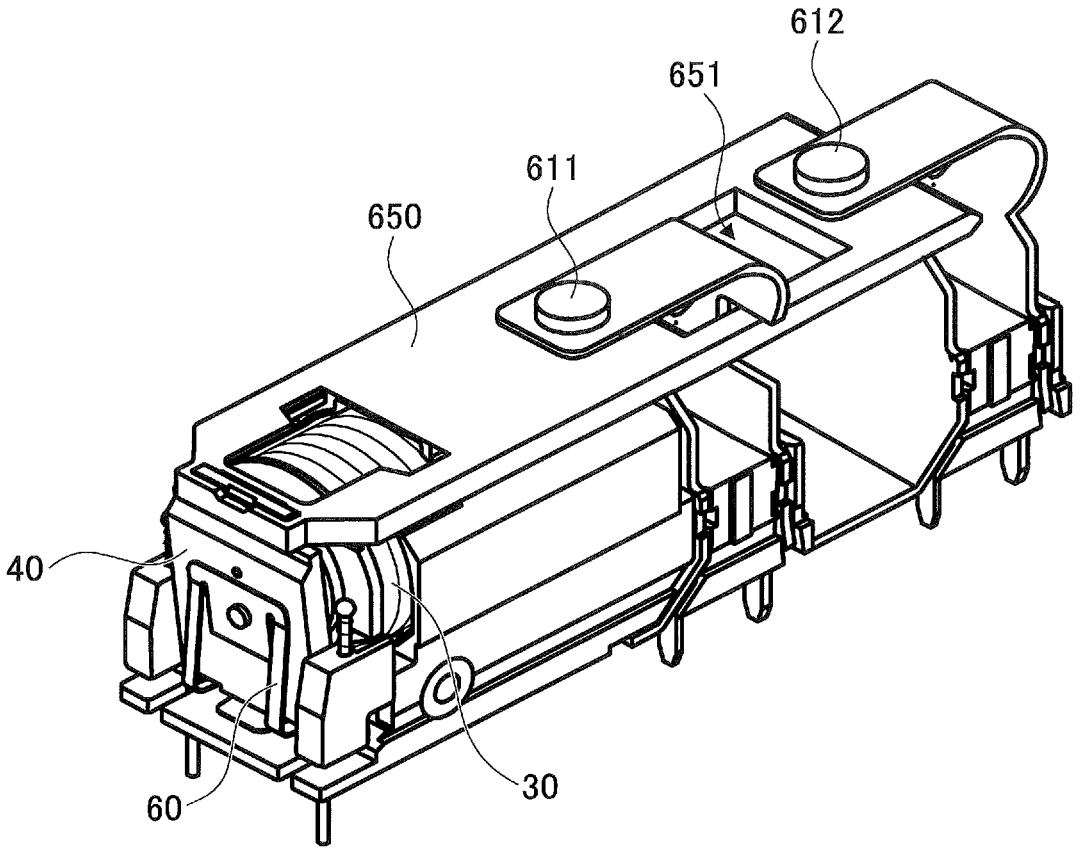
FIG. 10 is a perspective view of an electromagnetic relay according to a seventh embodiment.

FIG. 10 illustrates a state where the card 650 is interposed between the first fixed spring contact 611 and the corresponding second fixed spring contact and between the first fixed spring contact 612 and the corresponding second fixed spring contact as a result of, for example, being moved by a magnetic force due to a magnetic field generated by causing electric current to flow through the coil 30. In the state illustrated in FIG. 10, no electric power is supplied via the electromagnetic relay.

According to this embodiment, when the supply of electric current flowing through the coil 30 is stopped, the magnetic field that has been generated disappears, so that the card 650 moves. As a result, the opening 651 of the card 650 moves to a position where the first fixed spring contact 611 is provided, so that the first fixed spring contact 611 and the corresponding second fixed spring contact come into contact. Furthermore, because the card 650 is pulled out from between the first fixed spring contact 612 and the corresponding second fixed spring contact, the first fixed spring contact 612 and the corresponding second fixed spring contact come into contact. As a result, electric power is supplied via the electromagnetic relay.

The seventh embodiment may be otherwise the same as the first embodiment. Furthermore, the seventh embodiment may be applied to any of the second through sixth embodiments. Furthermore, according to this embodiment, the number of pairs of first and second fixed spring contacts is not limited to two, and may be three or more.

All examples and conditional language provided herein are intended for pedagogical purposes of aiding the reader in understanding the invention and the concepts contributed by the inventors to further the art, and are not to be construed as limitations to such specifically recited examples and conditions, nor does the organization of such examples in the specification relate to a showing of the superiority or inferiority of the invention. Electromagnetic relays have been described based on one or more embodiments of the present invention. It should be understood, however, that the various changes, substitutions, and alterations could be made hereto without departing from the spirit and scope of the invention.

What is claimed is:

1. An electromagnetic relay, comprising:

a coil;

an armature;

an iron core;

a first contact;

a second contact; and a card formed of an insulating material, and having a first end connected to the armature and a second end opposite to the first end, the second end including a tapered portion that is tapered outward in a direction away from the first end to define a terminal end of the card, wherein the first contact and the second contact are in contact when there is no flow of electric current through the coil, and wherein the first contact and the second contact are separated with the armature being attracted to the iron core to interpose the card between the first contact and the second contact, when there is a flow of electric current through the coil.

2. The electromagnetic relay as claimed in claim 1, wherein a through hole is provided in the card, and the first contact and the second contact are in contact in the through hole.

3. The electromagnetic relay as claimed in claim 1, wherein the card includes a first surface and a second surface that contact the first contact and the second contact, respectively, when the card is interposed between the first contact and the second contact, a groove is formed in each of the first surface and the second surface to extend from the second end in a first direction toward the first end to define a first sidewall and a second sidewall that are across the groove from each other in a second direction perpendicular to the first direction, and when the card is interposed between the first contact and the second contact, the sidewalls come into contact with the first contact and the second contact to separate the first contact and the second contact.

4. The electromagnetic relay as claimed in claim 1, wherein the card includes a plurality of grooves formed at the second end thereof, the plurality of grooves extending in a direction perpendicular to a direction from the first end to the second end of the card.

5. The electromagnetic relay as claimed in claim 1, wherein the first contact includes a first support and a first contact projection provided at an end portion of the first support, the second contact includes a second support and a second contact projection provided at an end portion of the second support, the card includes a card body, and an end portion thinner than the card body, provided at the second end of the card, when the first contact and the second contact are in contact, the first contact projection and the second contact projection are in contact, when the first contact and the second contact that are in contact separate, the card body interposes between and contacts the first support and the second support to separate the first contact projection and the second contact projection, and the end portion of the card interposes between the first contact projection and the second contact projection after the first contact projection and the second contact projection are separated by the contact of the card body with the first support and the second support.

6. The electromagnetic relay as claimed in claim 1, further comprising:

an additional first contact; and an additional second contact, wherein the additional first contact and the additional second contact are in contact when there is no flow of electric current through the coil, and wherein the additional first contact and the additional second contact are separated with the armature being attracted to the iron core to interpose the card between the additional first contact and the additional second contact, when there is the flow of electric current through the coil.

7. An electromagnetic relay, comprising:

a coil;

an armature;

an iron core;

a card directly connected to the armature and formed of an insulator;

a hinge spring attached to the armature to urge the armature in a direction away from the iron core;

a first contact; and a second contact, wherein the first contact and the second contact are separated with the card being interposed between the first contact and the second contact, when there is no flow of electric current through the coil, and the armature is attracted to the iron core to move the card to bring the first contact and the second contact into contact, when there is a flow of electric current through the coil.

8. An electromagnetic relay, comprising:

a coil;

an armature;

an iron core;

a scissors-shaped insulating member including a plurality of movable parts each connected to the armature by one of a plurality of rods, the scissors-shaped insulating member being configured to be opened and closed by a movement of the plurality of rods;

a first contact; and a second contact, wherein the scissors-shaped insulating member is opened to bring the first contact and the second contact into contact, when there is no flow of electric current through the coil, and the armature is attracted to the iron core to move the plurality of rods so that each of the plurality of rods presses one of the plurality of movable parts to close the scissors-shaped insulating member, so that the scissors-shaped insulating member is interposed between the first contact and second contact to separate the first contact and the second contact, when there is a flow of electric current through the coil.

9. The electromagnetic relay as claimed in claim 1, further comprising:

a hinge spring attached to the armature to urge the armature in a direction away from the iron core.

* * * * *